US011931635B1

(12) United States Patent
Hayes

(10) Patent No.: US 11,931,635 B1
(45) Date of Patent: Mar. 19, 2024

(54) BALL TOSSING DEVICE

(71) Applicant: Ronald Hayes, Los Angeles, CA (US)

(72) Inventor: Ronald Hayes, Los Angeles, CA (US)

( * ) Notice: Subject to any disclaimer, the term of this patent is extended or adjusted under 35 U.S.C. 154(b) by 0 days.

(21) Appl. No.: 17/946,108

(22) Filed: Sep. 16, 2022

(51) Int. Cl.

| | |
|---|---|
| ***A63B 65/12*** | (2006.01) |
| ***A63B 59/20*** | (2015.01) |
| ***A63B 60/10*** | (2015.01) |
| ***F41B 3/02*** | (2006.01) |
| ***F41B 3/04*** | (2006.01) |
| *A63B 63/00* | (2006.01) |

(52) U.S. Cl.
CPC ..... *A63B 65/122* (2013.01); *A63B 59/20* (2015.10); *A63B 60/10* (2015.10); *F41B 3/02* (2013.01); *A63B 63/004* (2013.01); *F41B 3/04* (2013.01)

(58) Field of Classification Search
CPC . F41B 3/02; F41B 3/04; A63B 65/122; A63B 59/20; A63B 59/30; A63B 60/10; A63B 60/12; A63F 7/2409
See application file for complete search history.

(56) References Cited

U.S. PATENT DOCUMENTS

| | | | | | |
|---|---|---|---|---|---|
| 532,132 | A | | 1/1895 | Zaremba | |
| 1,279,654 | A | | 9/1918 | Charlesworth | |
| 1,281,236 | A | * | 10/1918 | Vincent | F41B 3/02 124/17 |
| 1,374,420 | A | * | 4/1921 | Berggreen | F42B 6/003 473/585 |
| 1,436,408 | A | * | 11/1922 | Scott | F41B 3/00 D21/454 |
| 2,193,441 | A | * | 3/1940 | Batkin | A63B 65/122 124/16 |
| 2,247,852 | A | | 7/1941 | Saunders | |
| 2,667,863 | A | * | 2/1954 | Styles | F41B 3/02 124/20.1 |
| 3,428,036 | A | * | 2/1969 | Parker | A63B 59/20 73/862.541 |
| 3,517,657 | A | * | 6/1970 | Alban | F41B 3/02 124/20.3 |
| 3,589,349 | A | * | 6/1971 | Parker | A63B 60/08 124/5 |
| 3,602,505 | A | | 8/1971 | Friend | |
| 3,870,307 | A | | 3/1975 | Meyer | |
| 4,050,439 | A | * | 9/1977 | Rudy | F41B 3/02 124/16 |

(Continued)

FOREIGN PATENT DOCUMENTS

| | | | | |
|---|---|---|---|---|
| DE | 202008010030 | * | 10/2008 | A63B 65/122 |
| FR | 1031454 A | * | 6/1953 | A63B 65/122 |

*Primary Examiner* — John E Simms, Jr.

(57) ABSTRACT

A ball tossing device for use in playing a ball tossing game includes a rod, which is substantially rigid, a basket, which is attached to a front face of the rod proximate to an upper end of the rod, and a cup, which is positioned in the basket and which is attached to a bottom of the basket. The cup is sized complementarily to a portion of a ball to be used in a ball tossing game, allowing the portion of the ball to be inserted into and retained by the cup when the rod is substantially vertical. A rear sight is attached to and extends from the upper end of the rod. The rod can be grasped in a hand of a user, positioning the user to align the rear sight with a target and to launch the ball at the target by one or both of a flick of a wrist or an extension of a forearm of the user.

13 Claims, 9 Drawing Sheets

(56) References Cited

U.S. PATENT DOCUMENTS

| | | | | | |
|---|---|---|---|---|---|
| 4,125,106 | A * | 11/1978 | Kelly | F41B 3/02 | 124/17 |
| 4,198,949 | A * | 4/1980 | Cook | F41B 3/02 | 33/263 |
| 4,411,248 | A * | 10/1983 | Kivenson | F41B 3/02 | 124/900 |
| 5,282,634 | A * | 2/1994 | Chamberland | A63B 59/30 | 81/418 |
| 5,362,066 | A * | 11/1994 | Sassak | A63B 67/197 | 473/573 |
| 5,522,598 | A | 6/1996 | Loyd | | |
| 5,692,979 | A | 12/1997 | Jones | | |
| 5,803,067 | A * | 9/1998 | Ellenburg | F41B 3/02 | 124/20.1 |
| 5,918,585 | A * | 7/1999 | Blanchard | F41B 3/02 | 124/20.1 |
| 5,954,337 | A | 9/1999 | Cunningham | | |
| 6,780,129 | B1 | 8/2004 | Higuchi | | |
| 9,463,346 | B1 * | 10/2016 | Farmen | A63B 21/4035 | |
| 10,195,503 | B1 * | 2/2019 | Lesh | F41J 9/18 | |
| 10,220,282 | B1 * | 3/2019 | Steinkraus | A01K 15/027 | |
| 2002/0132705 | A1 * | 9/2002 | Hsieh | A63B 23/14 | 482/44 |
| 2008/0252017 | A1 | 10/2008 | Rowan | | |
| 2009/0203458 | A1 * | 8/2009 | Presley | A63B 63/00 | 473/157 |
| 2012/0006309 | A1 | 1/2012 | Levin | | |
| 2015/0137454 | A1 * | 5/2015 | Burks | F41B 3/04 | 124/5 |
| 2016/0375333 | A1 * | 12/2016 | Fryer | A63B 67/02 | 473/409 |

* cited by examiner

BALL TOSSING DEVICE

CROSS-REFERENCE TO RELATED APPLICATIONS

Statement Regarding Federally Sponsored Research or Development

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to ball tossing devices and more particularly pertains to a new ball tossing device for use in playing a ball tossing game. The present invention discloses a ball tossing device which allows a user to aim and to toss a ball as part of a ball tossing game.

(2) Description of Related Art Including Information Disclosed Under 37 CFR 1.97 and 1.98

The prior art relates to ball tossing devices whereby a person uses a hand-held tool to facilitate tossing a ball during gameplay. What is lacking in the prior art is a ball tossing device comprising a substantially rigid rod to which a basket is attached. A ball to be used in a ball tossing game can be positioned in a cup that in the basket. A rear sight attached to the rod is aligned with a target and the ball is launched.

BRIEF SUMMARY OF THE INVENTION

An embodiment of the disclosure meets the needs presented above by generally comprising a rod, which is substantially rigid, a basket, which is attached to a front face of the rod proximate to an upper end of the rod, and a cup, which is positioned in the basket and which is attached to a bottom of the basket. The cup is sized complementarily to a portion of a ball to be used in a ball tossing game. The cup is configured for selective insertion of the portion of the ball so that the ball is retained in the cup when the rod is substantially vertical. A rear sight is attached to and extends from the upper end of the rod. The rod is configured to be grasped in a hand of a user, positioning the user to align the rear sight with a target and to launch the ball at the target by one or both of a flick of a wrist or an extension of a forearm of the user.

Another embodiment of the disclosure includes a method comprising a provision step, which entails providing a target and a ball tossing device, as described above. The target then is positioned as desired for game play. The rod is grasped, held substantially vertically and the portion of the ball into the cup so that the ball is retained in the cup. The rear sight is aligned with the target. The ball is launched at the target by one or both of a flicking of a wrist and or extending of a forearm.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
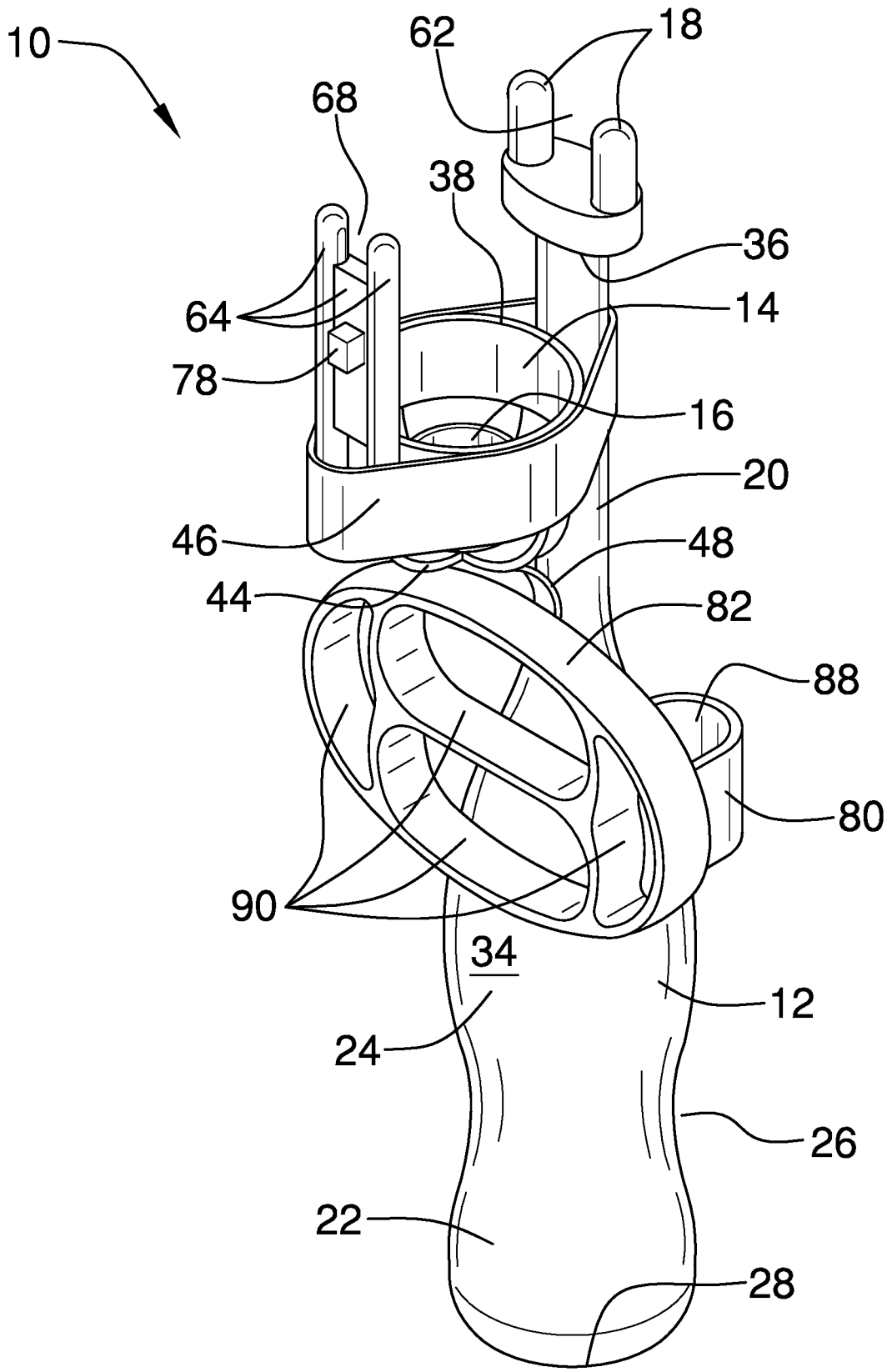
FIG. 1 is a front isometric perspective view of a ball tossing device according to an embodiment of the disclosure.
Figure 2:
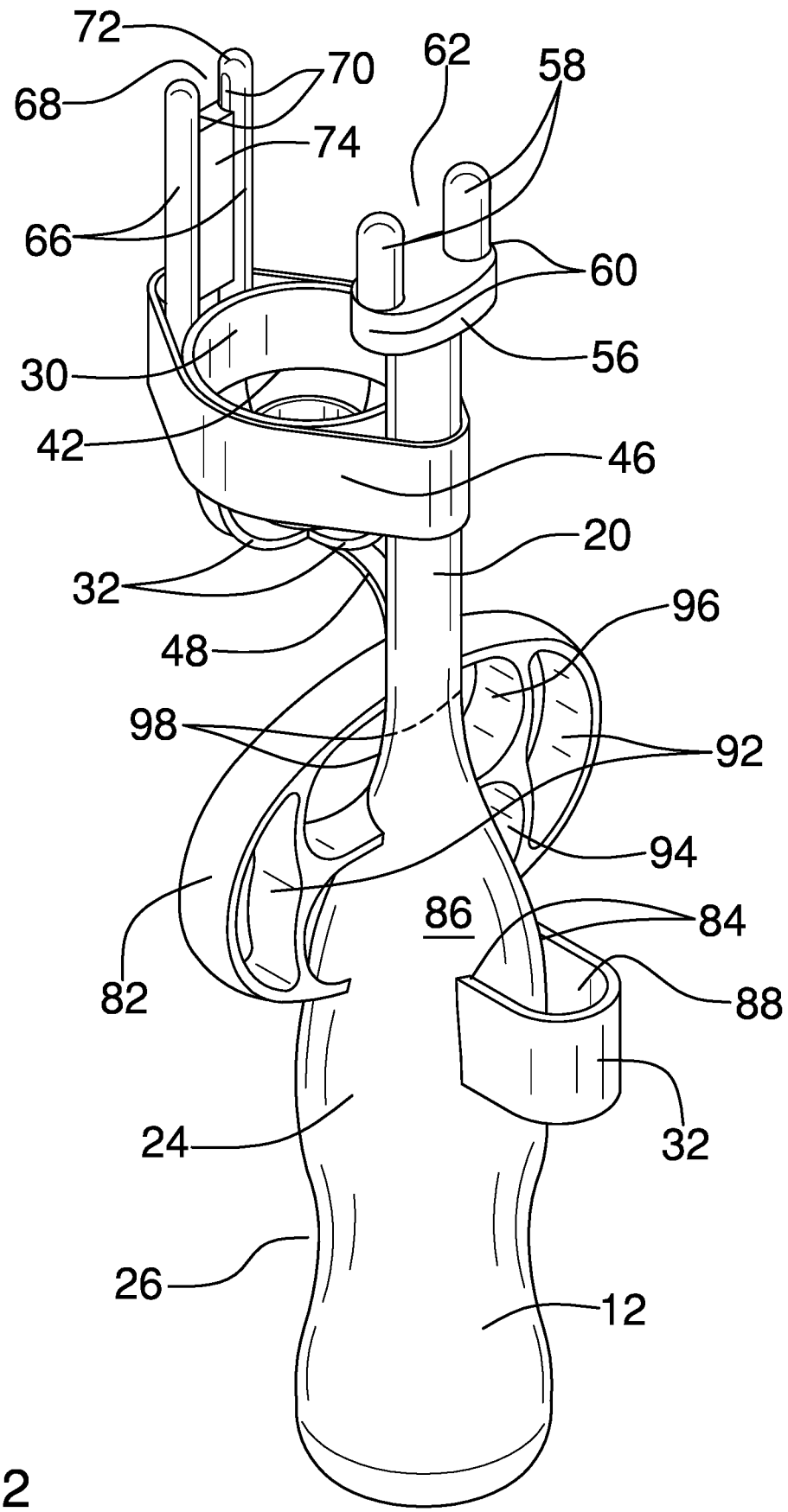
FIG. 2 is a rear isometric perspective view of an embodiment of the disclosure.

With reference now to the drawings, and in particular to FIGS. 1 through 10 thereof, a new ball tossing device embodying the principles and concepts of an embodiment of the disclosure and generally designated by the reference numeral 10 will be described.

As best illustrated in FIGS. 1 through 10, the ball tossing device 10 generally comprises a rod 12, a basket 14, a cup 16, and a rear sight 18. The rod 12 is substantially rigid and comprises an upper section 20, which is cylindrical, a base section 22, which is circumferentially larger than the upper section 20, and a medial section 24, which is attached to and which extends between the upper section 20 and the base section 22. The medial section 24 is ovoid and circumferentially larger than the upper section 20. The base section 22 and the medial section 24 together are hourglass shaped and define a recess 26, which extends circumferentially around the rod 12. As will become apparent, the rod 12 is configured as such to optimize a grip of a hand of a user upon the rod 12. A lower end 28 of the rod 12 may be planar to facilitate resting of the rod 12 on a surface.

The basket 14, which comprises an upper ring 30 and a pair of arcuate bars 32, is attached to a front face 34 of the rod 12 proximate to an upper end 36 of the rod 12. The upper ring 30 is attached to the rod 12 and defines a top 38 of the basket 14. Each arcuate bar 32 has opposing ends 40, which are attached to a lower limit 42 of the upper ring 30 so that the arcuate bars 32 are mutually perpendicular and define a bottom 44 of the basket 14.

A support ring 46, which is attached to and which extends around the rod 12 and the upper ring 30, and a support bar 48, which is attached to and which extends arcuately between the bottom 44 of the basket 14 and the front face 34 of the rod 12, serve to stabilize the basket 14 relative to the rod 12.

Figure 7:
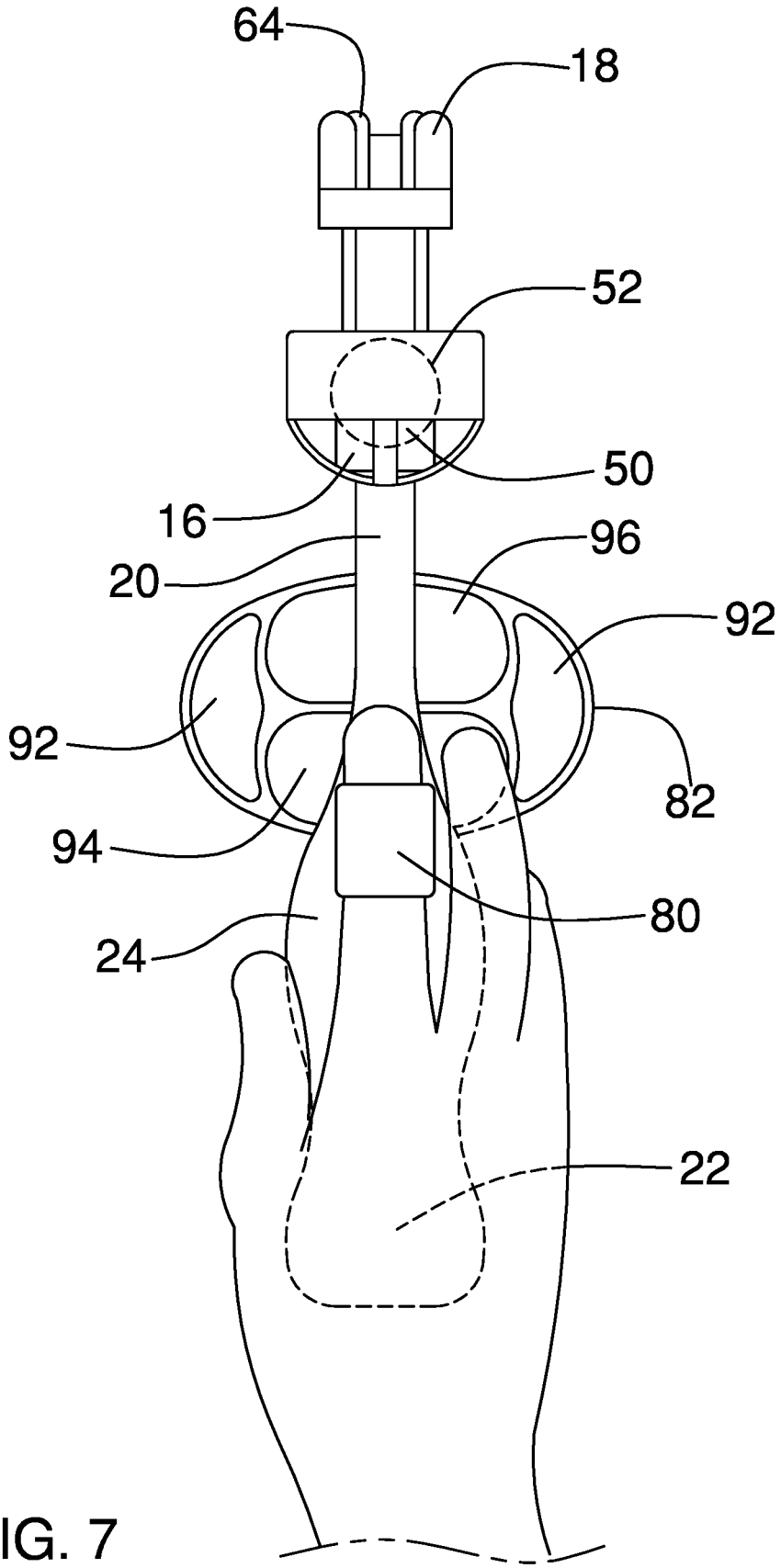
FIG. 7 is an in-use view of an embodiment of the disclosure.
Figure 8:
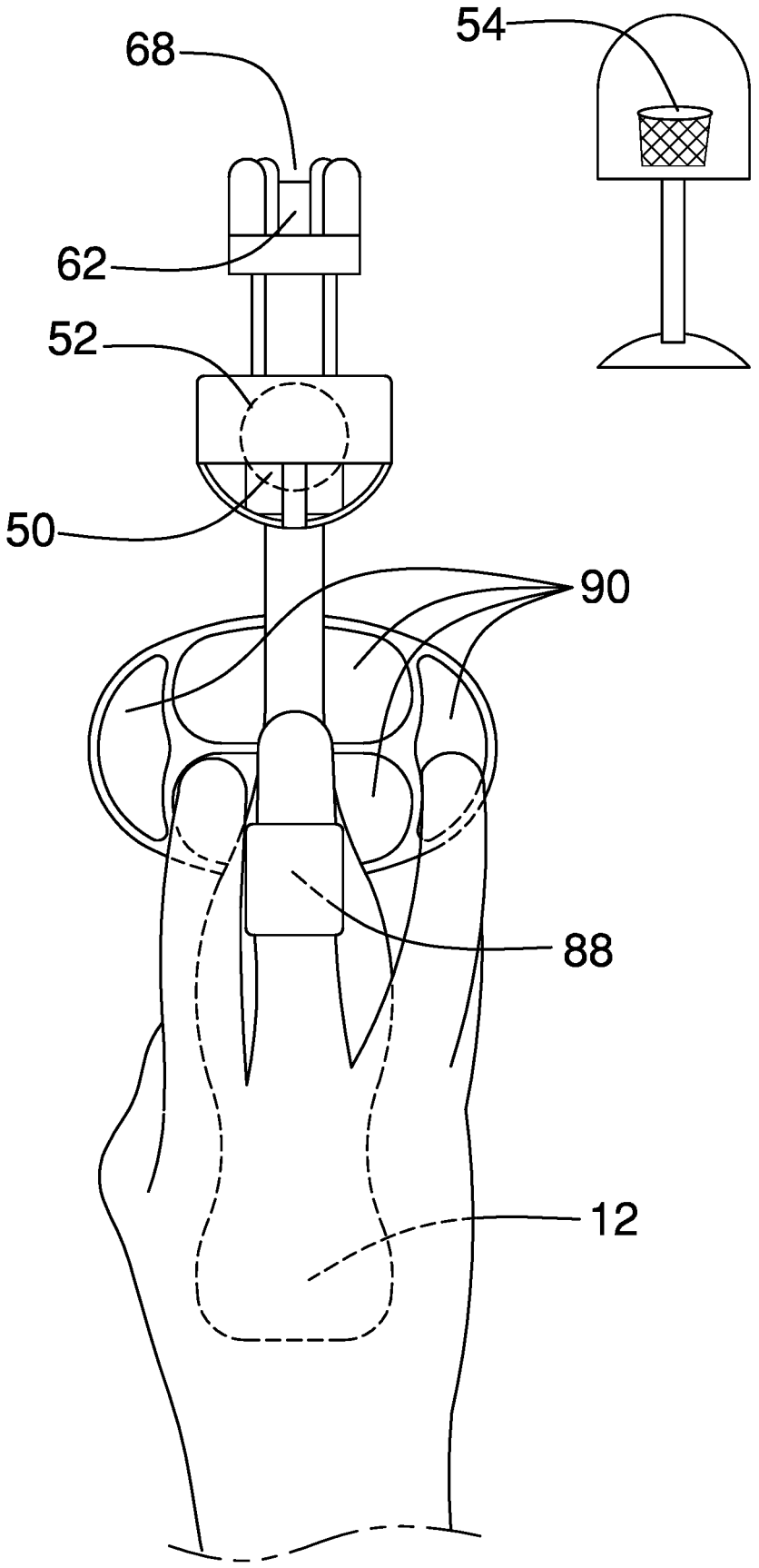
FIG. 8 is an in-use view of an embodiment of the disclosure.
Figure 9:
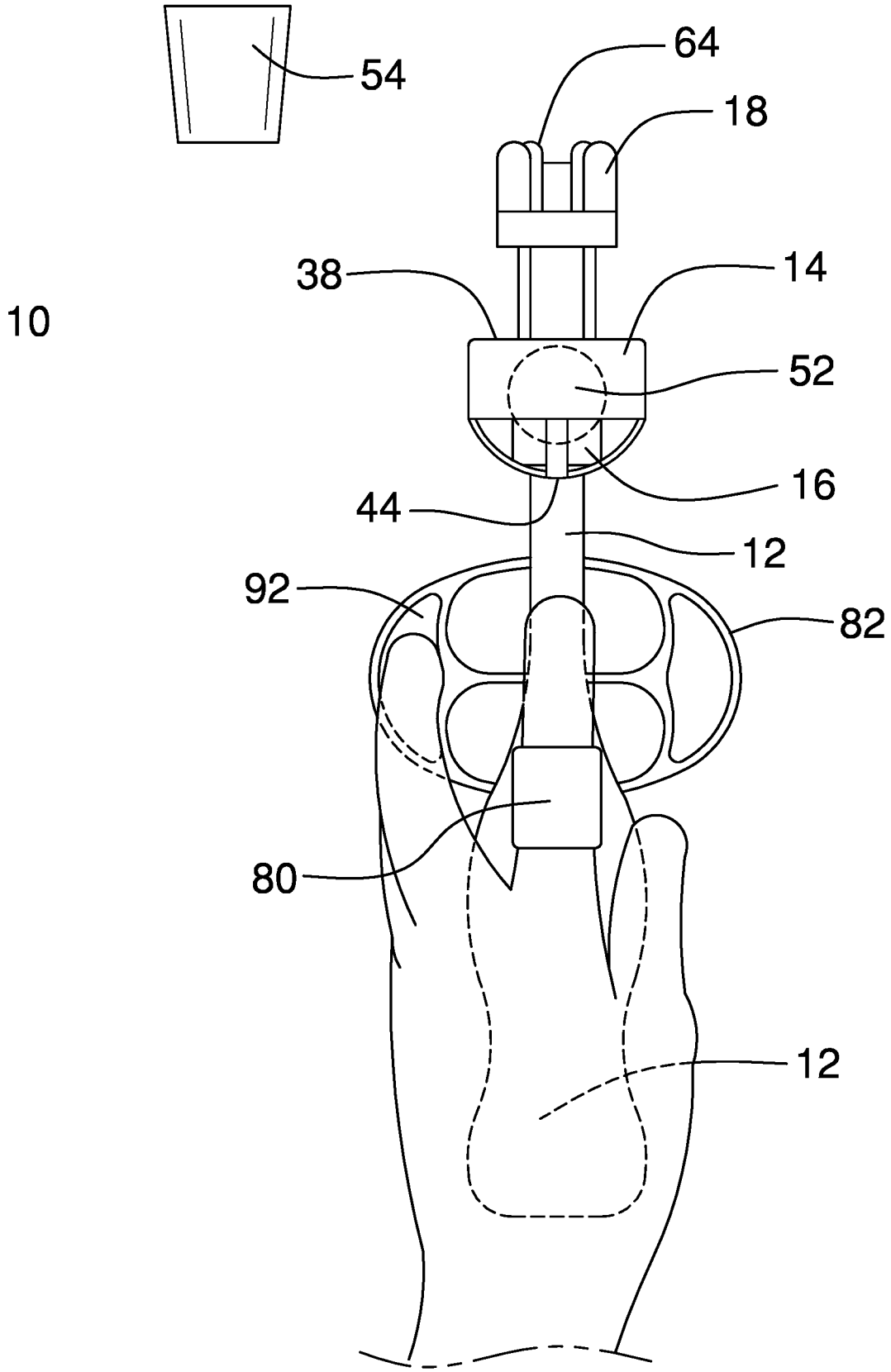
FIG. 9 is an in-use view of an embodiment of the disclosure.
Figure 10:
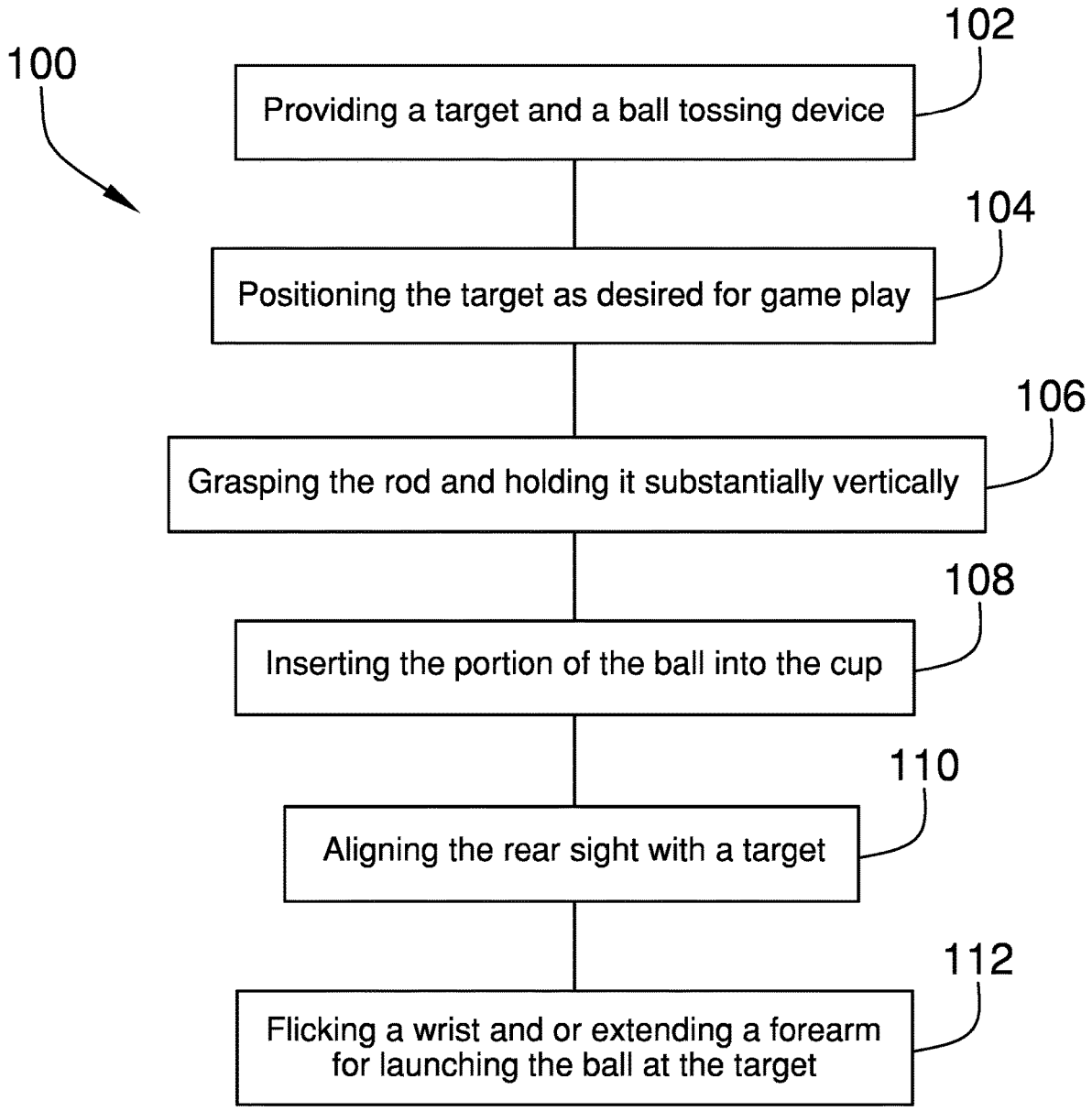
FIG. 10 is a flow diagram for a method utilizing an embodiment of the disclosure.

The cup 16 is positioned in the basket 14 and is attached to the bottom 44 of the basket 14. The cup 16 is sized complementarily to a portion 50 of a ball 52 to be used in a ball tossing game. The cup 16 is configured for selective insertion of the portion 50 of the ball 52 so that the ball 52 is retained in the cup 16 when the rod 12 is substantially vertical, as shown in FIGS. 7-9.

The rear sight 18 is attached to and extends from the upper end 36 of the rod 12. The rod 12 is configured to be grasped in the hand of the user, positioning the user to align the rear sight 18 with a target 54 and to launch the ball 52 at the target 54 by one or both of a flick of a wrist or an extension of a forearm of the user. The present invention is used in ball tossing games, wherein a ball 52 is tossed toward a target 54, such as, but not limited to, hoops, buckets, cans, boards having holes, and the like. The present invention also can be used in a ball tossing game wherein the ball 52 and the target 54 together comprise a hook and loop fastener.

The rear sight 18 may comprise a rear plate 56 and a pair of rear posts 58. The rear plate 56 is attached to and extends bilaterally from the upper end 36 of the rod 12. The rear posts 58 are attached to and extend from the rear plate 56. Each rear post 58 is positioned proximate to a respective opposed end 60 of the rear plate 56 and is opposingly positioned on the rear plate 56 relative to the rod 12. The pair of rear posts 58 defines a rear gap 62. The user is positioned to align the rear gap 62 with the target 54 prior to launching the ball 52 at the target 54.

The ball tossing device 10 also may comprise a front sight 64, which is attached to the basket 14. The front sight 64 is opposingly positioned relative to the rod 12 and extends codirectionally with the rod 12. The user is positioned to align the front sight 64 and the rear sight 18 with the target 54 prior to launching the ball 52.

The front sight 64 may comprise a pair of front posts 66, which is attached to and which extends from the basket 14. The front posts 66 define a front gap 68, positioning the user to align the front gap 68 and the rear gap 62 with the target 54 prior to launching the ball 52 at the target 54. The front posts 66 and the rear posts 58 are cylindrical. As such, should the ball 52 contact either of the pair of front posts 66 or the pair of rear posts 58 upon launch from the basket 14, the direction of travel of the ball 52 will be substantially unaltered.

Each slot 70 of a pair of slots 70 is positioned in an inner face 72 of a respective front post 66. A sight plate 74 is slidably positioned in the pair of slots 70 and is configured to be selectively positioned within the pair of slots 70 to adjust a vertical length 76 of the front gap 68. Such adjustment allows the user to selectively lower and raise their aim through the rear sight 18 and front sight 64. A nub 78 is attached to and extends from the sight plate 74 and is configured to be engaged by a finger of the user to selectively position the sight plate 74 within the pair of slots 70. The present invention anticipates the rear sight 18 and the front sight 64 comprising other sighting means, such as, but not limited to, the front sight 64 comprising a ring, the rear sight 18 comprising a cross, a disc, or the like, and other combinations known to those skilled in the art of sights.

The ball tossing device 10 also comprises a finger bar 80 and an ovoid panel 82. Opposite ends 84 of the finger bar 80 are attached to a rear face 86 of the rod 12, thereby defining a finger loop 88. The finger bar 80 is positioned between the basket 14 and the lower end 28 of the rod 12. The finger loop 88 is configured for insertion of a respective finger of the user, such as an index finger or a middle finger, as shown in FIG. 7 and FIG. 8, respectively.

Figure 3:
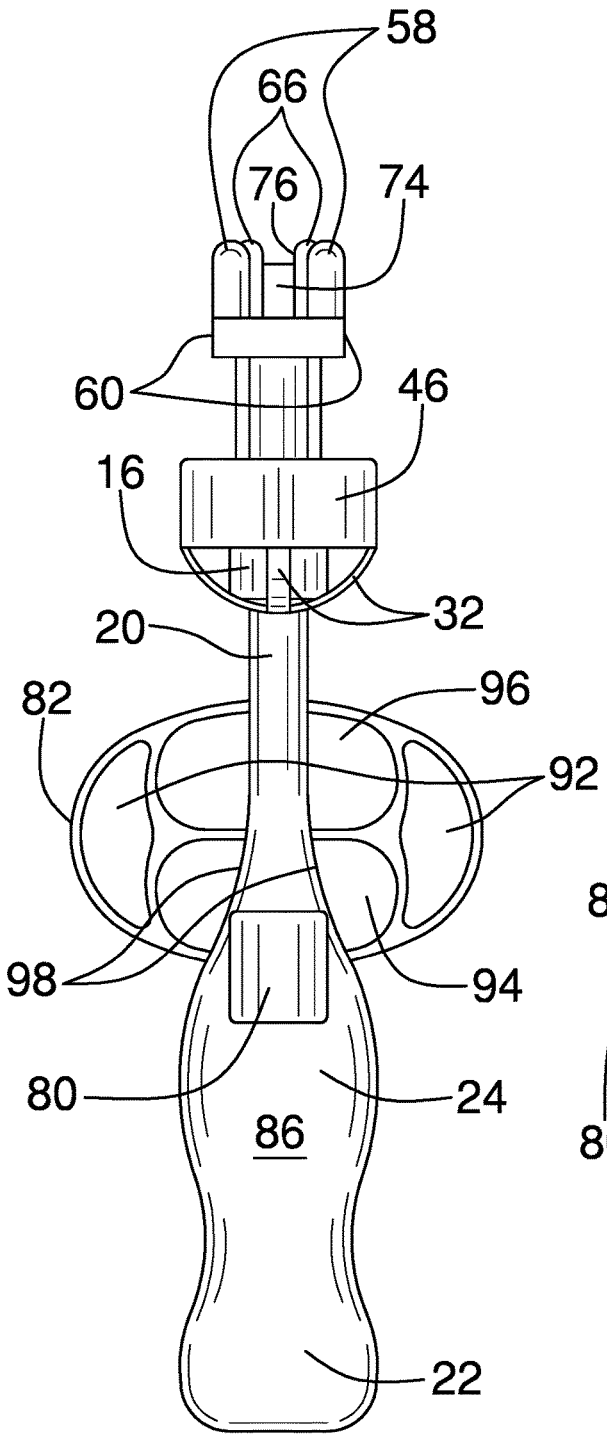
FIG. 3 is a rear view of an embodiment of the disclosure.
Figure 4:
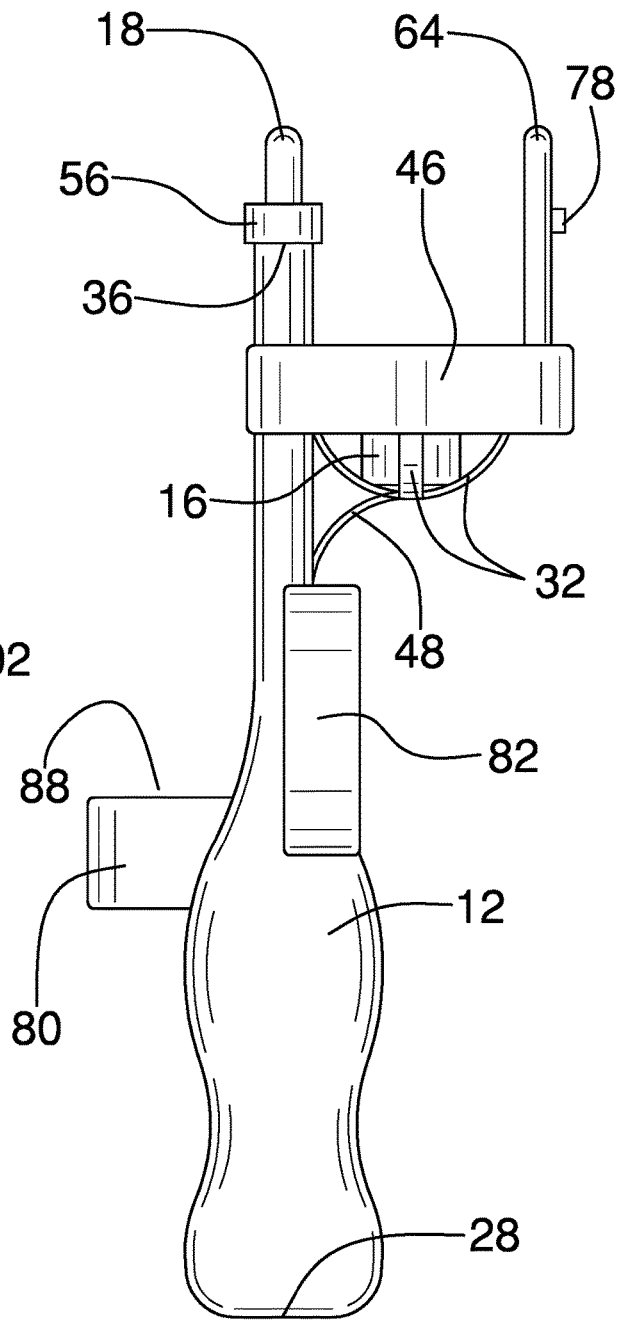
FIG. 4 is a side view of an embodiment of the disclosure.
Figure 5:
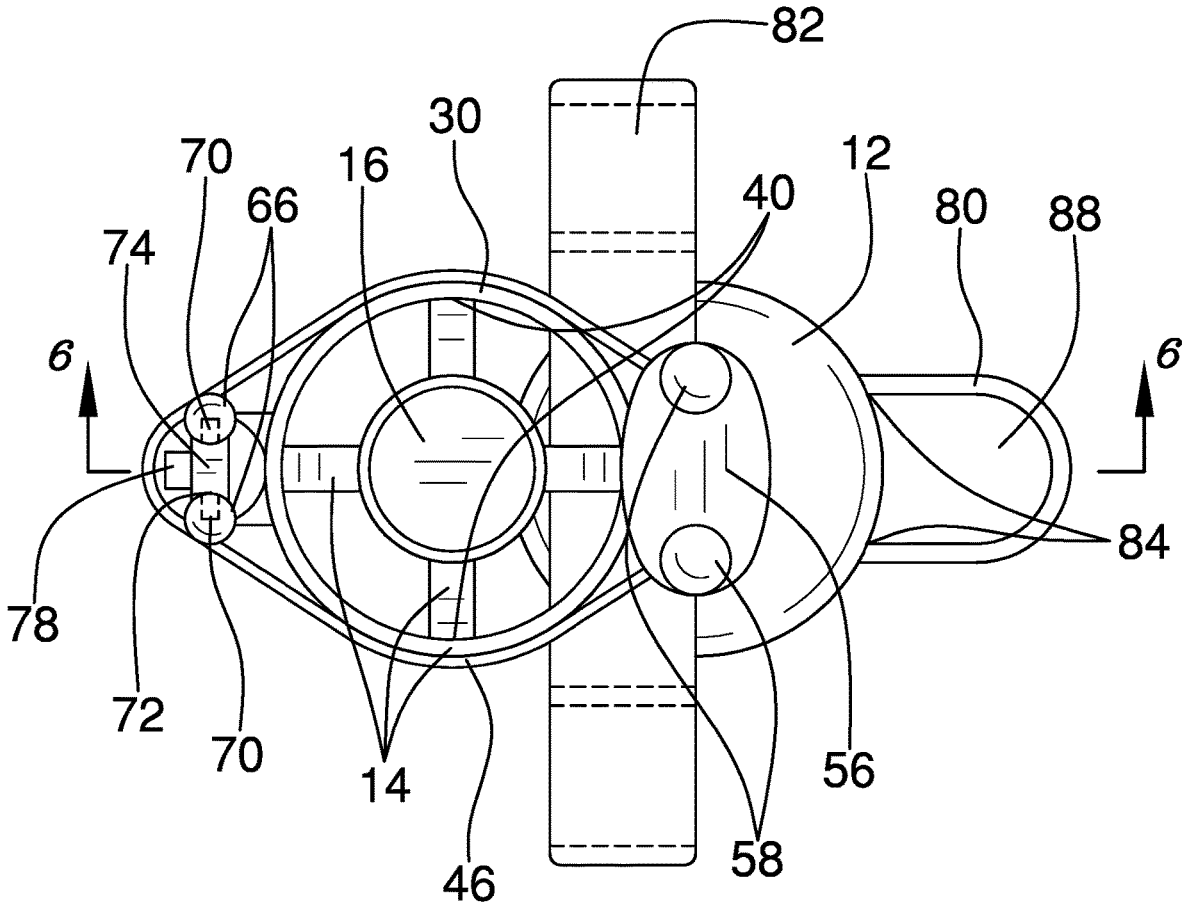
FIG. 5 is a top view of an embodiment of the disclosure.
Figure 6:
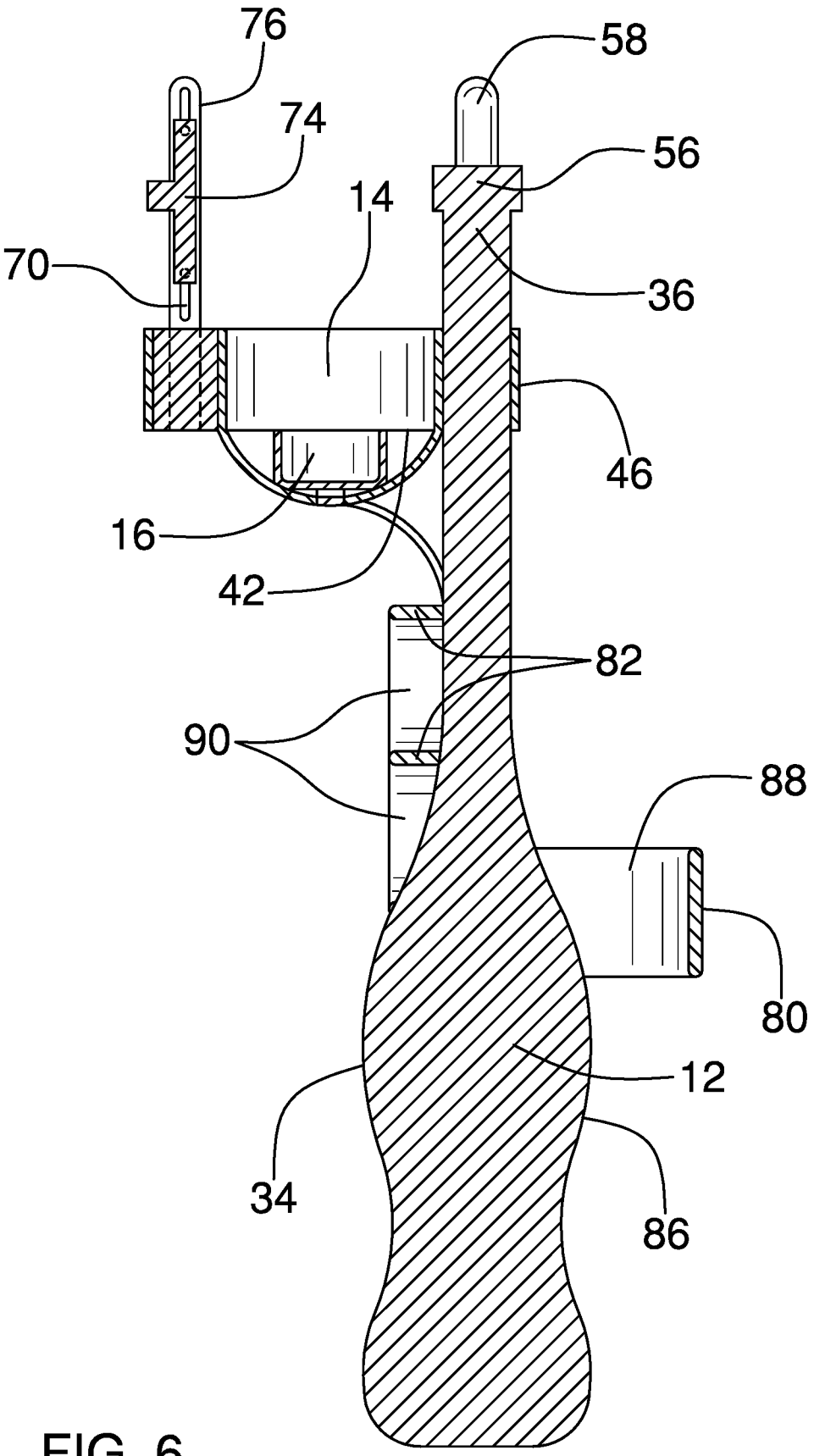
FIG. 6 is a cross-sectional view of an embodiment of the disclosure.

The ovoid panel 82 is attached to the front face 34 of the rod 12, extends from the finger bar 80 toward the basket 14, and extends bilaterally from the rod 12. A plurality of openings 90 is positioned in the ovoid panel 82, with each opening 90 being configured for selective insertion of a respective finger of the user. The plurality of openings 90 comprises a pair of first cutouts 92, which is positioned singly distal from the rod 12, a proximate cutout 94, which extends bilaterally from the rod 12 proximate to the finger bar 80, and a distal cutout 96, which extends bilaterally from the rod 12 distal from the finger bar 80. As shown in FIG. 3, the proximate cutout 94 and the distal cutout 96 are accessible from either of opposite sides 98 of the rod 12. As shown in FIGS. 7-9, the finger loop 88 and the plurality of openings 90 allow for different variations in gripping and accommodate hands of a variety of sizes.

In use, the ball tossing device 10 enables a method of playing a ball tossing game 100 comprises a provision step 102, which entails providing a ball tossing device 10, according to the specification above, and a target 54. A setup step 104 of the method 100 entails positioning the target 54 as desired for game play. A holding step 106 of the method 100 entails grasping the rod 12 and holding it substantially vertically. A loading step 108 of the method 100 entails inserting the portion 50 of the ball 52 into the cup 16 so that the ball 52 is retained in the cup 16. A first execution step 110 of the method 100 entails aligning the rear sight 18 with the target 54. A second execution 112 step of the method 100 entails flicking a wrist and/or extending a forearm to launch the ball 52 at the target 54.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A ball tossing device comprising:

a rod, the rod being substantially rigid;

a basket attached to a front face of the rod proximate to an upper end of the rod;

a cup positioned in the basket and attached to a bottom of the basket, the cup being sized complementarily to a portion of a ball to be used in a ball tossing game, wherein the cup is configured for selective insertion of the portion of the ball, such that the ball is retained in the cup when the rod is substantially vertical;

a rear sight attached to and extending from the upper end of the rod, wherein the rod is configured for grasping in a hand of a user, positioning the user for aligning the rear sight with a target and for launching the ball at the target by one or both of a flick of a wrist or an extension of a forearm of the user, wherein the basket comprises an upper ring attached to the rod and defining a top of the basket, and a pair of arcuate bars, each arcuate bar having opposing ends attached to a lower limit of the upper ring, such that the arcuate bars are mutually perpendicular and define the bottom of the basket; and a support ring attached to and extending around the rod and the upper ring for stabilizing the basket relative to the rod.

2. The ball tossing device of claim 1, wherein the rod comprises:

an upper section, the upper section being cylindrical;

a base section, the base section being circumferentially larger than the upper section; and a medial section attached to and extending between the upper section and the base section, the medial section being ovoid and circumferentially larger than the upper section, such that the base section and the medial section together are hourglass shaped and such that the medial section and the base section define a recess extending circumferentially around the rod.

3. The ball tossing device of claim 1, further including a support bar attached to and extending arcuately between the bottom of the basket and the front face of the rod for stabilizing the basket relative to the rod.

4. The ball tossing device of claim 1, wherein the rear sight comprises:

a rear plate attached to and extending bilaterally from the upper end of the rod; and a pair of rear posts attached to and extending from the rear plate, each rear post being positioned proximate to a respective opposed end of the rear plate and being opposingly positioned on the rear plate relative to the rod, such that the pair of rear posts defines a rear gap, positioning the user for aligning the rear gap with the target and for launching the ball at the target.

5. The ball tossing device of claim 4, further including a front sight attached to the basket, the front sight being opposingly positioned relative to the rod and extending codirectionally with the rod, positioning the user for aligning the front sight and the rear sight with the target prior to launching the ball.

6. The ball tossing device of claim 5, wherein the front sight comprises a pair of front posts attached to and extending from the basket defining a front gap, positioning the user for aligning the front gap and the rear gap with the target prior to launching the ball at the target.

7. The ball tossing device of claim 6, wherein the front posts and the rear posts are cylindrical.

8. The ball tossing device of claim 1, further including a finger bar having opposite ends attached to a rear face of the rod defining a finger loop, the finger bar being positioned between the basket and a lower end of the rod, wherein the finger loop is configured for insertion of a respective finger of the user.

9. The ball tossing device of claim 8, further including:

an ovoid panel attached to the front face of the rod and extending from the finger bar toward the basket, the ovoid panel extending bilaterally from the rod; and a plurality of openings positioned in the ovoid panel, wherein each opening is configured for selective insertion of a respective finger of the user.

10. The ball tossing device of claim 1, further comprising:

the rod comprising:

an upper section, the upper section being cylindrical, a base section, the base section being circumferentially larger than the upper section, and a medial section attached to and extending between the upper section and the base section, the medial section being ovoid and circumferentially larger than the upper section, such that the base section and the medial section together are hourglass shaped and such that the medial section and the base section define a recess extending circumferentially around the rod;

a support bar attached to and extending arcuately between the bottom of the basket and the front face of the rod for stabilizing the basket relative to the rod;

the rear sight comprising:

a rear plate attached to and extending bilaterally from the upper end of the rod, and a pair of rear posts attached to and extending from the rear plate, each rear post being positioned proximate to a respective opposed end of the rear plate and being opposingly positioned on the rear plate relative to the rod, such that the pair of rear posts defines a rear gap, positioning the user for aligning the rear gap with the target and for launching the ball at the target;

a front sight attached to the basket, the front sight being opposingly positioned relative to the rod and extending codirectionally with the rod, positioning the user for aligning the front sight and the rear sight with the target prior to launching the ball, the front sight comprising:

a pair of front posts attached to and extending from the basket defining a front gap, positioning the user for aligning the front gap and the rear gap with the target prior to launching the ball at the target, the front posts and the rear posts being cylindrical, a pair of slots, each slot being positioned in an inner face of a respective front post, a sight plate slidably positioned in the pair of slots, wherein the sight plate is configured for being selectively positioned within the pair of slots for adjusting a vertical length of the front gap, allowing the user to selectively lower and raise their aim through the rear sight and front sight, and a nub attached to and extending from the sight plate, wherein the nub is configured for being engaged by a finger of the user for selectively positioning the sight plate within the pair of slots;

a finger bar having opposite ends attached to a rear face of the rod defining a finger loop, the finger bar being positioned between the basket and a lower end of the rod, wherein the finger loop is configured for insertion of a respective finger of the user;

an ovoid panel attached to the front face of the rod and extending from the finger bar toward the basket, the ovoid panel extending bilaterally from the rod; and a plurality of openings positioned in the ovoid panel, wherein each opening is configured for selective insertion of a respective finger of the user, the plurality of openings comprising:

a pair of first cutouts positioned singly distal from the rod, a proximate cutout extending bilaterally from the rod proximate to the finger bar, and a distal cutout extending bilaterally from the rod distal from the finger bar.

11. A ball tossing device comprising:

a rod, the rod being substantially rigid;

a basket attached to a front face of the rod proximate to an upper end of the rod;

a cup positioned in the basket and attached to a bottom of the basket, the cup being sized complementarily to a portion of a ball to be used in a ball tossing game, wherein the cup is configured for selective insertion of the portion of the ball, such that the ball is retained in the cup when the rod is substantially vertical;

a rear sight attached to and extending from the upper end of the rod, wherein the rod is configured for grasping in a hand of a user, positioning the user for aligning the rear sight with a target and for launching the ball at the target by one or both of a flick of a wrist or an extension of a forearm of the user;

wherein the rear sight comprises a rear plate attached to and extending bilaterally from the upper end of the rod, and a pair of rear posts attached to and extending from the rear plate, each rear post being positioned proximate to a respective opposed end of the rear plate and being opposingly positioned on the rear plate relative to the rod, such that the pair of rear posts defines a rear gap, positioning the user for aligning the rear gap with the target and for launching the ball at the target;

a front sight attached to the basket, the front sight being opposingly positioned relative to the rod and extending codirectionally with the rod, positioning the user for aligning the front sight and the rear sight with the target prior to launching the ball, wherein the front sight comprises a pair of front posts attached to and extending from the basket defining a front gap, positioning the user for aligning the front gap and the rear gap with the target prior to launching the ball at the target;

a pair of slots, each slot being positioned in an inner face of a respective front post; and a sight plate slidably positioned in the pair of slots, wherein the sight plate is configured for being selectively positioned within the pair of slots for adjusting a vertical length of the front gap, allowing the user to selectively lower and raise their aim through the rear sight and front sight.

12. The ball tossing device of claim 11, further including a nub attached to and extending from the sight plate, wherein the nub is configured for being engaged by a finger of the user for selectively positioning the sight plate within the pair of slots.

13. A ball tossing device comprising:

a rod, the rod being substantially rigid;

a basket attached to a front face of the rod proximate to an upper end of the rod;

a cup positioned in the basket and attached to a bottom of the basket, the cup being sized complementarily to a portion of a ball to be used in a ball tossing game, wherein the cup is configured for selective insertion of the portion of the ball, such that the ball is retained in the cup when the rod is substantially vertical;

a rear sight attached to and extending from the upper end of the rod, wherein the rod is configured for grasping in a hand of a user, positioning the user for aligning the rear sight with a target and for launching the ball at the target by one or both of a flick of a wrist or an extension of a forearm of the user;

a finger bar having opposite ends attached to a rear face of the rod defining a finger loop, the finger bar being positioned between the basket and a lower end of the rod, wherein the finger loop is configured for insertion of a respective finger of the user;

an ovoid panel attached to the front face of the rod and extending from the finger bar toward the basket, the ovoid panel extending bilaterally from the rod;

a plurality of openings positioned in the ovoid panel, wherein each opening is configured for selective insertion of a respective finger of the user;

wherein the plurality of openings comprises:

a pair of first cutouts positioned singly distal from the rod;

a proximate cutout extending bilaterally from the rod proximate to the finger bar; and a distal cutout extending bilaterally from the rod distal from the finger bar.

* * * * *